United States Patent [19]

McCarty

[11] Patent Number: 4,658,544

[45] Date of Patent: Apr. 21, 1987

[54] DOOR ASSEMBLY

[76] Inventor: Lon H. McCarty, 217 SE. Palmblad St., Gresham, Oreg. 97030

[21] Appl. No.: 781,941

[22] Filed: Sep. 30, 1985

[51] Int. Cl.[4] ..... E05D 7/06

[52] U.S. Cl. ..... 49/236; 49/9; 49/34; 49/501; 16/240

[58] Field of Search ..... 49/236, 237, 396, 9, 49/34, 171; 16/309, 235, 240

[56] References Cited

U.S. PATENT DOCUMENTS

| | | | |
|---|---|---|---|
| 1,055,167 | 3/1913 | Hanson | 16/240 |
| 1,997,951 | 4/1935 | Skreberg | 49/236 |
| 4,402,159 | 9/1982 | Domagalski | 49/34 X |
| 4,570,384 | 2/1986 | Eckel | 49/501 |

FOREIGN PATENT DOCUMENTS

| | | | |
|---|---|---|---|
| 1902197 | 8/1969 | Fed. Rep. of Germany | 49/9 |

*Primary Examiner*—Kenneth Downey

*Attorney, Agent, or Firm*—Klarquist, Sparkman, Campbell, Leigh & Whinston

[57] ABSTRACT

A door construction includes first and second panels which are thermally bonded together at their peripheral edges. A hinge receiving pocket is defined between these panels. A door supporting hinge section is insertable into this pocket for supporting the door in place. An adjustment mechanism on the door supporting hinge section tilts the outer edge of the door relative to the inner edge of the door for adjusting the alignment of the door within a door opening after the hinge is installed.

10 Claims, 6 Drawing Figures

DOOR ASSEMBLY

BACKGROUND OF THE INVENTION

The present invention relates to a swinging door and to a hinge for supporting such a door in a door opening.

Heretofore, swinging doors for door openings have been known, including doors supported by gravity operated hinge mechanisms. Some of these doors have been made of a flexible material, but in a manner which has made them relatively difficult to manufacture and which has interfered with their durability.

For example, in one prior art door, two panels of pvc are sewn or glued together to form the door. Such a manufacturing approach is somewhat time consuming. In addition, doors constructed in the manner suffer from the drawback that the panels may separate during use. In some cases, a hinge receiving pocket has been provided at the upper end of such doors between the panels. Gravity operated hinges including a mounting bracket and a door supporting arm are used to support such doors with the arm being inserted into the pocket. However, to adjust the alignment of the door relative to the door framework, shims are used to shim the hinge mounting bracket for adjustment purposes. These shims are somewhat time consuming and difficult to install.

Prior art doors have also been provided with a seal at the peripheral edges of the doors. One form of seal is constructed by sandwiching a piece of rubber or other gasket material between an edge margin of the door and an overlying piece of flat aluminum stock. The sandwich is secured to the door such that the rubber abuts the door framework, the floor or an adjoining door for sealing purposes. Such seals lack durability. In addition, when a gravity operated hinge is used to support a door, the upper edge of the door rises as the door is pushed or pulled open. As a result, the use of rigid material such as aluminum in a seal is not suitable for the upper edges of such a door. That is, this material would tend to drag against and damage the upper door framework as the gravity operated hinge raises the door as it is opened.

Another approach to sealing such doors has involved the use of a cloth loop glued to the opposite sides of the door. This has proven less than optimum because of the tendency of such cloth seals to tear and pull free from the door during heavy use.

Therefore, a need exists for a mechanically simple, relatively lightweight, door assembly that is easy to install and remove.

SUMMARY OF THE INVENTION

It is therefore one object of the present invention to provide an improved swinging door construction.

It is still another object of the invention to provide an improved hinge for such a door, the hinge having a mechanism for easily adjusting the alignment of the door in the door opening.

A still further object of the invention is to provide a door construction which is easy to manufacture, durable, aesthetically pleasing and which is easy to install and remove as desired.

In accordance with the above objects, one illustrated door assembly in accordance with the present invention includes first and second rectangular panels of a heat or thermally bondable material, the first and second panels being thermally bonded together at their peripheral margins. In addition, these panels define a hinge receiving pocket therebetween at an upper region of the bonded panels.

As another aspect of the present invention, the hinge receiving pocket is spaced from the upper edge of the door to provide clearance as the door is opened and closed.

As a more specific feature of the invention, an optional gasket may be thermally bonded to the peripheral edges of the door.

As still another aspect of the present invention, optional windows and optional door kick plates may be provided.

These and other objects, features and advantages of the present invention will become apparent with reference to the following description and drawings.

DETAILED DESCRIPTION OF PREFERRED EMBODIMENT

Figure 1:
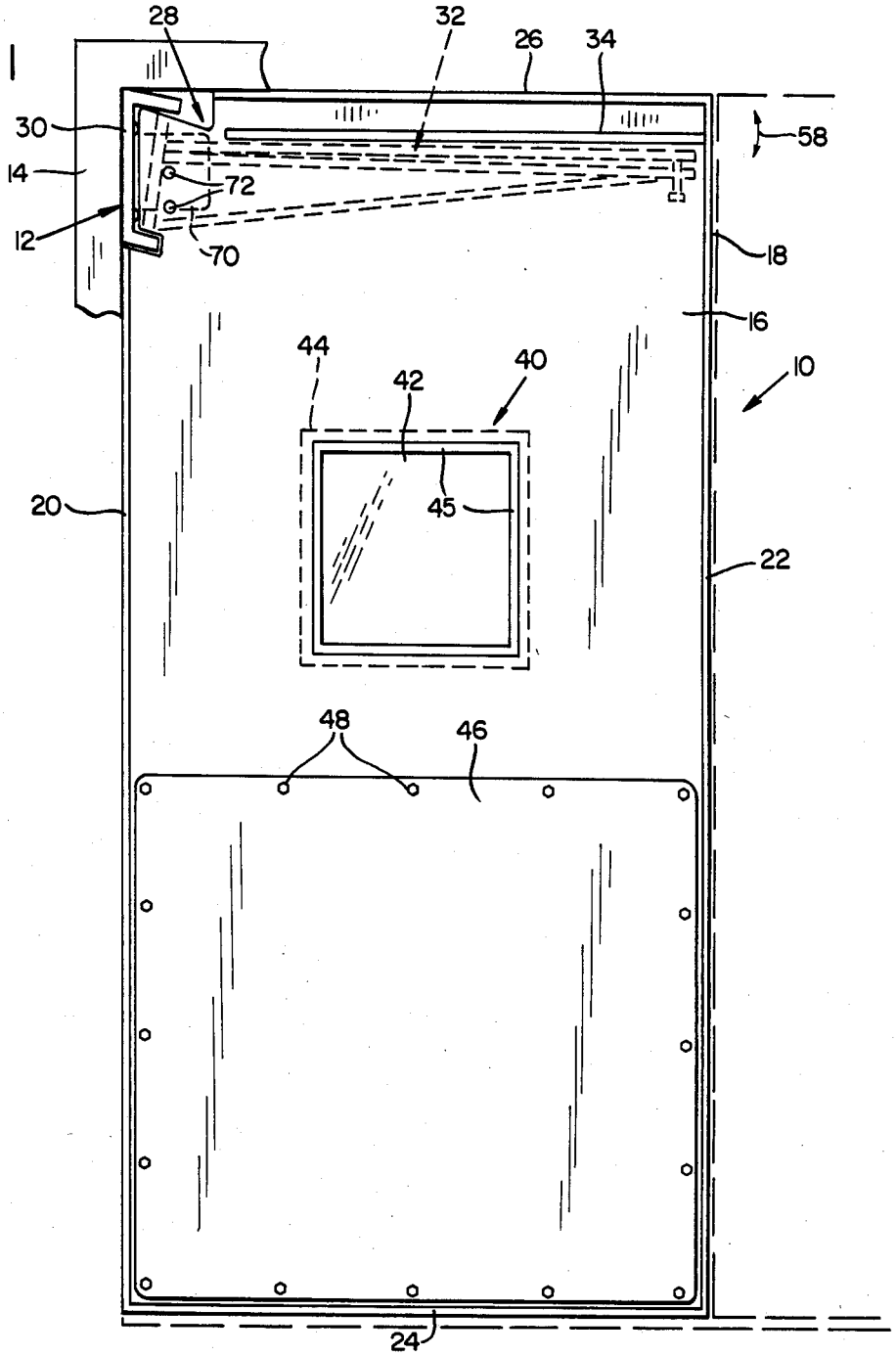
FIG. 1 is a front elevational view of one embodiment of a door assembly in accordance with the present invention.

With reference to FIG. 1, a swinging door assembly of the present invention includes a door construction 10 supported at its upper end by a hinge 12 which in turn is mounted to the framework 14 surrounding a door opening.

The FIG. 1 door construction is comprised of first and second generally rectangular front and rear panels 16 and 18 which are secured together at their peripheral edges. More specifically, the panels 16 and 18 are of a durable somewhat flexible themally fusable material, such as 0.120 inches thick pvc plastic. The panels 16 and 18 are heat welded together at their peripheries as indicated by side welds 20, 22, bottom weld 24 and top weld 26. Thermal fusing of the components of the door is accomplished utilizing commercially available heat welding equipment. When secured together in this manner, an interior hollow hinge receiving pocket is provided between the panels.

In FIG. 1, the upper left hand corner of each of the panels are cut, as explained in greater detail below, to remove an upper portion of the weld 20 and corner portion of weld 26. This provides a hinge receiving access opening 28 leading to the interior space between the panels.

The hinge 12 includes a mounting bracket portion 30 secured to the framework 14 and an elongated door supporting portion 32 which extends through opening 28 and into the pocket between the panels of the door.

In the illustrated embodiment, hinge 12 comprises a gravity operated hinge which returns to the position illustrated in FIG. 1, and closes the door, after the door has been pushed or pulled open in either direction. With such a hinge, the door rises slightly as it is opened. To permit this motion, the door supporting portion is positioned at a location spaced from the framework. This is accomplished by heat welding the panel 16 and 18 together along a transverse line 34 extending from weld 22 at the outer edge of the door toward the hinge opening 28. Weld 34 terminates short of the hinge receiving access opening 28 so that it does not interfere with the insertion of hinge portion 32 into the pocket between the panels 16 and 18. With this construction, the upper portion of the door panels, between welds 26 and 34, flex as the door is opened and closed and the upper weld 26 rises against the framework. Therefore, the door supporting hinge portion 32 does not drag against the framework and interfere with this movement.

The door construction 10 includes an optional window 40 provided at eye level in the door panels. A rectangular or square opening is provided through each of the panels 16 and 18. A clear durable heat fusable material 42, such as 0.120 inches thick pvc plastic, is then positioned in this opening. This sheet 42 is sized larger than the window openings such that portions of the sheet, indicated generally at 44, are sandwiched between the panels. The panels are thermally fused along the periphery 45 of the window openings to secure the sheet 42 in place and also secure the panels together at this location.

High impact kick plates, one being shown at 46, are optionally secured to the lower portion of each panel 16, 18 to protect the door where it is typically hit by carts, boxes and so forth. Rivets 48 secure the kick plates in place. High impact abs plastic is one suitable kick plate material.

Thus, an easily manufactured and durable door construction is provided.

Figure 2:
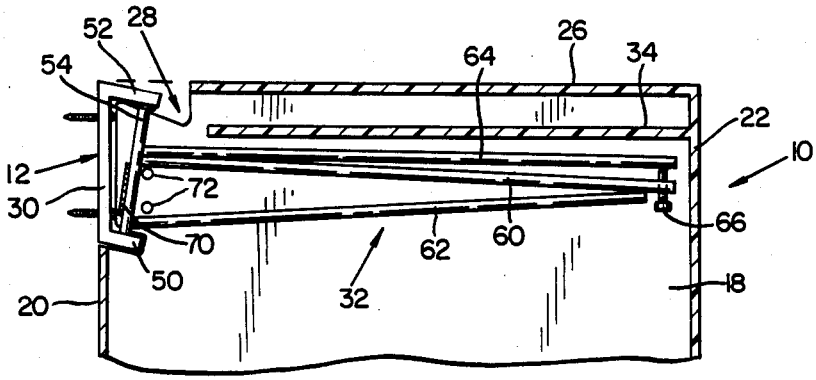
FIG. 2 is a broken away sectional view of the upper portion of the door assembly of FIG. 1.
Figure 3:
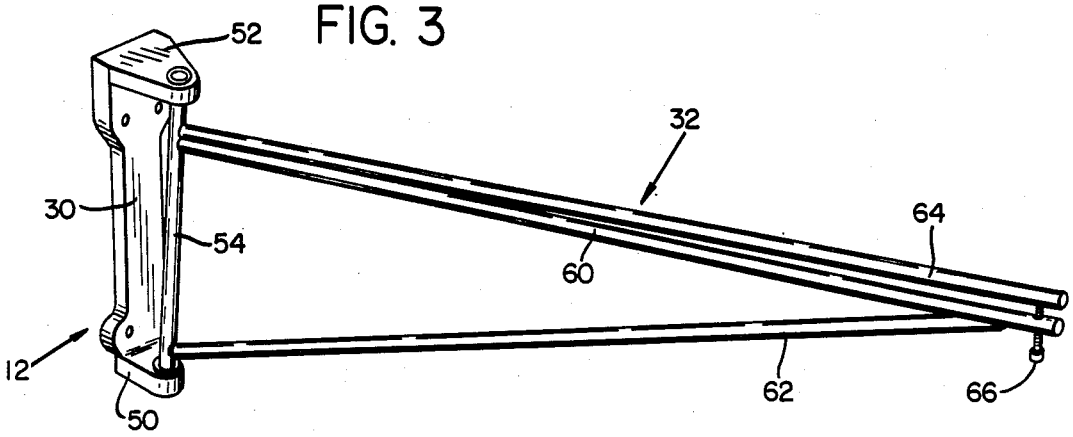
FIG. 3 is a front perspective view of a hinge in accordance with the present invention.

With reference to FIGS. 2 and 3, the hinge 12, as previously indicated, may comprise a gravity operated hinge. More specifically, the mounting bracket 30 includes spaced apart mounting flanges 50, 52 which project outwardly and downwardly from the upper side portion of door supporting framework 14. The door supporting hinge section 32 includes a pivot pin 54 pivotally mounted, as by bushings, to the flanges 50 and 52. Hinge section 32 projects outwardly from the pivot 44 and typically ranges from eighteen to forty-eight inches long, with thirty inches being a common length.

The door supporting hinge includes a means for adjusting the elevation of the outer portion of the door relative to the inner portion. This is accomplished by adjusting the outer portion of the hinge section 32, relative to the hinge bracket 30 as indicated by the allow 58 in FIG. 1. As a result, if a door framework is not entirely plumb, the adjustment mechanism enables the rapid adjustment of the door alignment within the door opening. This eliminates the time consuming installation of shims underneath the hinge bracket 30 or extensive door reframing.

In the illustrated embodiment, with reference to FIGS. 2 and 3, the door supporting hinge section 32 includes a first projecting support comprised of an upper arm or rod section 60 and a lower brace arm or rod 62. The arm section 60 and brace arm 62 are rigidly connected to and project outwardly from pin 54. A door alignment adjusting bar 64 also is rigidly connected to and projects from pin 54. Bar 64 is positioned above the arm section 60 and also beneath the weld 34 so as to support the door 10 substantially along the entire length of the bar. The components 54, 60, 62 and 64 of the hinge are typically made of a durable rigid material, such as steel, and are secured together at appropriate places, as by welding.

By spreading the free end of the bar 64 away from the free end of arm section 60, the outer edge of the door is raised relative to the inner edge of the door. Conversely, by shifting the free end of the bar 64 closer to the arm section 60, the outer edge of the door is lowered relative to the inner edge. This shifting, or adjustment of the door, is accomplished utilizing a mechanically simple adjusting mechanism. In the illustrated form, this mechanism comprises an adjustment screw 66 threaded through the arm section 60 and into engagement with the free end of the bar 64. As the screw 66 is turned, the bar 64 moves toward or away from the arm section 60 and tilts the door. The direction of movement is determined by the direction in which the adjustment screw is turned.

Therefore, after the hinge is mounted to the door framework 14, the door supporting hinge section 32 is inserted through opening 28 and into the hinge receiving pocket between the door panels. In the event the door requires adjustment, the door is removed, adjustment screw 66 is turned as required, and the door is reinstalled.

Figure 4:
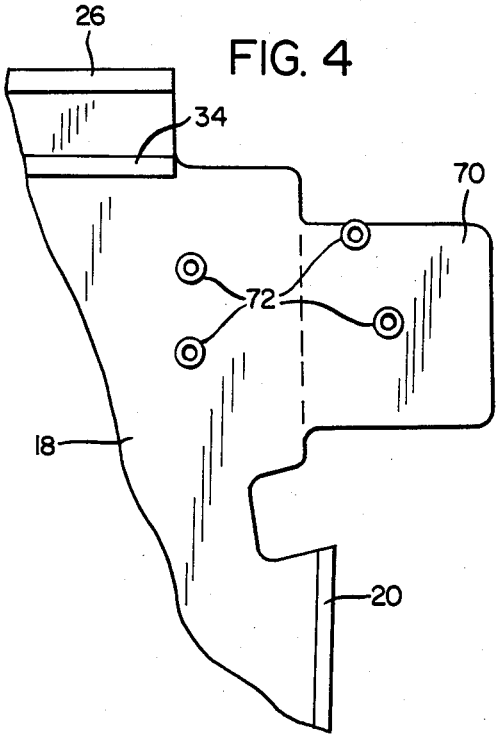
FIG. 4 is a partially broken away enlarged view of one portion of a panel utilized in the door construction of FIG. 1.

With reference to FIGS. 1, 2 and 4, one of the door panels, in this case panel 18, is provided with a hinge engaging flap 70. When the door supporting hinge section 32 is inserted into the hinge receiving pocket between the door panels, the flap 70 is wrapped around the pin 54 and inserted into the pocket. This improves the aesthetic appearance of the door hinge assembly as the flap shields much of the hinge from view. In addition, openings indicated generally at 72 in FIGS. 1, 2 and 4, surrounded by grommets, are provided in the flap 70 and each of the panels 16 and 18. These openings are aligned when the flap is inserted into the pocket. Bolts or other fasteners are inserted through these openings to secure the door 10 to the hinge 12.

Figure 6:
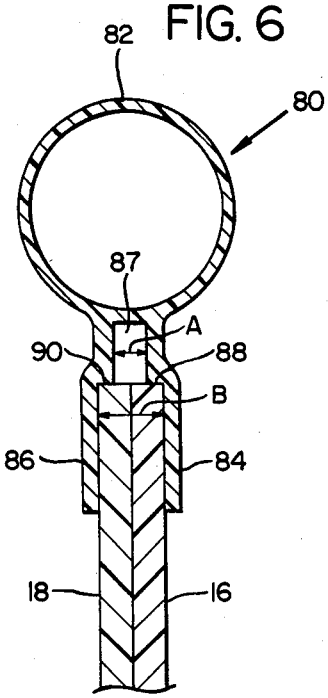
FIG. 6 is a sectional view of the gasket of FIG. 5 taken along line 6—6 thereof.
Figure 5:
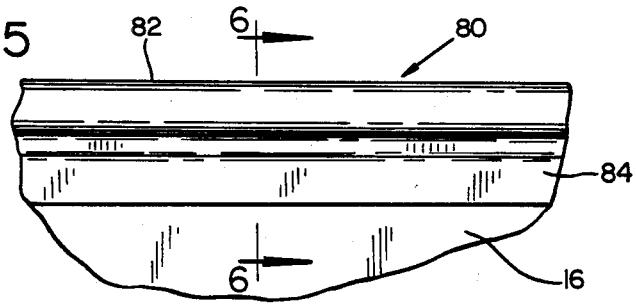
FIG. 5 is a fragmentary view of a portion of the peripheral margin of a door assembly with an optional gasket installed.

With reference to FIGS. 5 and 6, a door sealing gasket 80 may be provided along the entire peripheral edge margin of the door, except in the region of the hinge receiving opening 28. As shown in these figures, the illustrated door sealing gasket is extruded of a heat weldable or fusable and somewhat flexible material. For example, a pvc seal extruded to a thickness of approximatelv 0.05 inches is one suitable form of material.

The sealing gasket 80 of FIGS. 5 and 6 includes an outer elongated, hollow, deformable sealing strip 82 of circular cross-section from which spaced apart legs 84 and 86 project. At the point of connection to the strip 82, and a short distance therefrom, the legs 84 and 86 are spaced apart a distance A. Each of the legs 84, 86 is provided with a respective step 88, 90. At these steps, the spacing between the legs 84, 86 increases to a distance B. This distance B is approximately the thickness of the two panels 16, 18 prior to thermal bonding. Prior to such bonding, the gasket 80 is placed over the edge margins of the panels 16, 18 with the steps 80 and 90 abutting edges of these panels. During thermal bonding of the panels 16 and 18, the legs 84 and 86 are also bonded to the edge margins of the panels. In addition, during bonding, molten material from the panels may flow into a void 87 between legs 84, 86 adjacent to the strip 82. Consequently, when bonding is complete, the outer surface of the leg 84 is appoximately flush with the outer surface of the adjacent unbonded portion of the panel 16. In addition, the outer surface of the leg 86 is approximately flush with the outer surface of the adjacent unbonded portion of the panel 18.

With this construction, the seal 80 is securely mounted to the door panels and provides an effective seal of the door in the event such sealing is desired.

Having illustrated and described the principles of my invention with reference to one preferred embodiment, it should be apparent to those persons skilled in the art that such invention may be modified in arrangement and detail without departing from such principles. I claim as my invention all such modifications as come within the true spirit and scope of the following claims.

I claim:

1. A door construction comprising:

first and second rectangular panels of a heat weldable material, the first and second panels being heat welded together at the peripheral margins; and the first and second bonded panels defining a transversely extending hinge receiving pocket therebetween and at an upper region of the bonded first and second panels, the hinge receiving pocket having a hinge receiving access opening along one upper side margin of the first and second bonded panels.

2. A door construction according to claim 1 in which the first and second panels are thermally bonded together along a pocket boundary line spaced from the upper edge of the first and second bonded panels, the pocket boundary line defining the upper boundary of the hinge receiving pocket.

3. A door construction according to claim 1 in which one of the first and second panels includes a hinge covering flap positioned adjacent the hinge receiving pocket.

4. A door construction according to claim 1 in which the first and second panels each include a window opening, the window opening through the first panel being aligned with the window opening through the second panel, the door construction also including a window panel of a heat weldable material sized larger than the window openings, the window panel being positioned between the first and second panels so as to close the window openings, the first and second panels and window panel being thermally bonded together at the peripheral edges of the window openings.

5. A door construction according to claim 4 including elongated gasket means of a heat weldable material, the gasket means being positioned along the peripheral edges of the first and second rectangular panels and being heat welded to such panels along such peripheral edges, said gasket means including an outer deformable closed cylindrical seal portion, first and second spaced apart legs projecting in one direction from the seal portion, the spacing between the side legs being sized for receiving the peripheral edge margins of the first and second panels therebetween.

6. A door construction comprising:

first and second rectangular panels of a heat weldable material, the first and second panels being heat welded together at the peripheral margins;

the first and second bonded panels defining a transversely extending hinge receiving pocket therebetween and at an upper region of the bonded first and second panels, the hinge receiving pocket having a hinge receiving access opening along one upper side margin of the first and second bonded panels;

the first and second panels each including a window opening, the window opening through the first panel being aligned with the window opening through the second panel, the door construction also including a window panel of a heat weldable material sized larger than the window openings, the window panel being positioned between the first and second panels so as to close the window openings, the first and second panels and window panel being thermally bonded together at the peripheral edges of the window openings;

kickplate means mounted to the outer surface of a lower region of at least one of the door panels for reinforcing such lower region; and elongated gasket means of a heat weldable material, the gasket means being positioned along the peripheral edges of the first and second rectangular panels and being heat welded to such panels along such peripheral edges, said gasket means including an outer deformable cylindrical seal portion, and first and second spaced apart legs projecting in one direction from the seal portion, the spacing between the legs being sized for receiving the peripheral edge margins of the first and second panels therebetween;

the gasket legs each including an internal step, the step of one of such gasket legs abutting the edge of a respective one of the first and second panels and the step of the other of such gasket legs abutting the edge of the other of such first and second panels when the first and second panels are inserted between the legs, the gasket means also defining a void between the seal portion and steps, whereby during heat welding material from the panels flows into the void.

7. A door assembly for mounting to the framework surrounding a door opening comprising:

first and second rectangular panels of a heat weldable material, the first and second panels being heat welded together at their peripheral edge margins; and the first and second panels defining a transversely extending hinge receiving pocket therebetween at an upper region of the bonded first and second panels, the hinge receiving pocket having a hinge receiving access opening at one upper side margin of the first and second bonded panels;

hinge means for supporting the thermally bonded first and second panels, the hinge means including mounting bracket means for mounting to the door framework and elongated door supporting means pivotally connected to the mounting means, the door supporting means being inserted into the hinge receiving pocket, the door supporting means having door alignment adjustment means for adjusting the elevation of the outer portion of the door relative to the inner portion of the door to thereby adjust the alignment of the door within the door opening.

8. A door assembly according to claim 7 in which the door supporting portion includes elongated arm means projecting outwardly from the mounting bracket and door supporting bar means positioned above the door supporting arm means, the first and second bonded panels being supported on the door supporting bar means, the free ends of the arm means and door supporting bar means spaced from the mounting bracket means being shiftable so as to vary the spacing from the free end of the door supporting bar means to the free end of the arm means, the door alignment adjustment means including means for adjusting such spacing to thereby adjust the door alignment.

9. A hinge for mounting a door assembly to a door framework surrounding a door opening, comprising:

mounting bracket means for mounting to the door framework;

elongated door supporting means pivotally connected to the mounting means and projecting outwardly therefrom, the door supporting means having means for adjusting the elevation of the outer portion of the door relative to the inner portion of the door;

wherein the door supporting means includes elongated are means projecting outwardly from the mounting bracket means and door supporting bar means positioned above the door supporting arm means, the free ends of the arm means and door supporting bar means spaced from the mounting bracket means being shiftable so as to vary the spacing from the free end of the door supporting bar means to the free end of the arm means, the door alignment means including means for adjusting such spacing to thereby adjust the door alignment.

10. A hinge according to claim 9 in which the last named means comprises threaded screw adjustment means threadedly mounted to the free end of one of the arm means or the door supporting bar means and engaging the other of the free end of the arm means or door supporting bar means.

* * * * *